US009837194B1

(12) United States Patent
Folker et al.

(10) Patent No.: US 9,837,194 B1
(45) Date of Patent: Dec. 5, 2017

(54) OUTPUT TRANSFORMER AND RESONANT INDUCTOR IN A COMBINED MAGNETIC STRUCTURE

(71) Applicant: Universal Lighting Technologies, Inc., Madison, AL (US)

(72) Inventors: Donald Folker, Madison, AL (US); Mike LeBlanc, Huntsville, AL (US); Candice Ungacta, Huntsville, AL (US); Wei Xiong, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 15/247,203

(22) Filed: Aug. 25, 2016

Related U.S. Application Data

(60) Provisional application No. 62/238,434, filed on Oct. 7, 2015.

(51) Int. Cl.

| | |
|---|---|
| ***H01F 27/30*** | (2006.01) |
| ***H01F 17/06*** | (2006.01) |
| ***H01F 27/24*** | (2006.01) |
| ***H01F 3/14*** | (2006.01) |
| ***H01F 27/32*** | (2006.01) |

(52) U.S. Cl.
CPC ..... *H01F 3/14* (2013.01); *H01F 27/325* (2013.01)

(58) Field of Classification Search
USPC ..... 336/198
See application file for complete search history.

(56) References Cited

U.S. PATENT DOCUMENTS

| | | | | |
|---|---|---|---|---|
| 2,561,855 A * | 7/1951 | Gould | H01F 38/10 | 315/280 |
| 4,931,761 A * | 6/1990 | Kijima | H01F 27/266 | 336/160 |
| 5,926,946 A * | 7/1999 | Minato | H01F 3/14 | 29/606 |
| 6,980,077 B1 * | 12/2005 | Chandrasekaran | H01F 27/255 | 336/212 |
| 7,646,281 B2 * | 1/2010 | Diekmann | H01F 27/263 | 336/234 |
| 8,031,042 B2 * | 10/2011 | Silva | H01F 3/10 | 336/178 |

* cited by examiner

*Primary Examiner* — Ronald Hinson
(74) *Attorney, Agent, or Firm* — Patterson Intellectual Property Law, P.C.; Mark J. Patterson; Jerry Turner Sewell

(57) ABSTRACT

A magnetic assembly includes a single bobbin structure that supports a first coil and a second coil. A first E-core has a center leg positioned within the first coil. A second E-core has a center leg positioned within the second coil. An I-core is positioned between the first E-core and the second E-core. The I-core completes a first set of magnetic paths between the center leg and outer legs of the first E-core and also completes a second set of magnetic paths between the center leg and outer legs of the second E-core. The two E-cores and the I-core are stacked in a vertical E-I-E configuration with respect to a common set of pin rails. In one embodiment, the first coil and the first E-core are configured as a transformer; and the second coil and the second E-core are configured as an inductor.

14 Claims, 17 Drawing Sheets

OUTPUT TRANSFORMER AND RESONANT INDUCTOR IN A COMBINED MAGNETIC STRUCTURE

CROSS-REFERENCES TO RELATED APPLICATIONS

This application claims benefit of the following patent application which is hereby incorporated by reference: U.S. Provisional Patent App. No. 62/238,434 filed Oct. 7, 2015, entitled "Output Transformer and Resonant Inductor in a Combined Magnetic Structure."

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND OF THE INVENTION

In a typical DC-DC converter circuit 100 illustrated in FIG. 1, the converter circuit receives a voltage from a DC source 110, which may be a DC voltage supply that produces a DC voltage from an AC source (not shown). In the illustrated converter circuit in FIG. 1, the DC source is illustrated as a conventional battery, and the voltage from the DC source is provided on a VRAIL supply line 112. The voltage on the VRAIL supply line is referenced to an input ground reference 114. A first semiconductor switch (e.g., a power metal oxide semiconductor field effect transistor (MOSFET) or bipolar junction transistor (BJT) 120 has a first terminal connected to the VRAIL supply line and has a second terminal connected to a common switching node 122. A second semiconductor switch (MOSFET or BJT) 124 has a first terminal connected to the common switching node and has a second terminal connected to the input ground reference. Together, the two switches operate as a half-bridge circuit 126 to produce a switched DC voltage on the common switching node.

The control terminal (e.g., gate of a MOSFET or base of a BJT) of the first switch 120 is connected to a first output 132 of an integrated circuit controller 130. The control terminal of the second switch 124 is connected to a second output 134 of the controller. The controller operates in a conventional manner to turn on the first switch to couple the common switching node 122 to the VRAIL supply line 112; and then turn on the second switch to couple the common switching node to the input ground reference 114. When one of the switches is turned on, the other switch is turned off. The two switches are turned on and off at a selected repetition rate and with selected duty cycles to produce a voltage on the common switching node that alternates between the VRAIL voltage and ground.

The common switching node 122 of the half-bridge circuit 126 is connected to a resonant tank circuit 140 that includes a resonant circuit inductor 142, a first clamping diode 144, and a second clamping diode 146. A first terminal of the resonant circuit inductor 142 is connected to the common switching node 122 of the half-bridge circuit. A second terminal of the resonant circuit inductor is connected to the anode of the first clamping diode and to the cathode of the second clamping diode at a resonant tank node 148. The cathode of the first clamping diode 144 is connected to the VRAIL supply line 112. The anode of the second clamping diode is connected to the input ground reference 114. The two clamping diodes prevent the voltage on the resonant tank node from exceeding the VRAIL voltage by more than one diode forward voltage drop and from going below the input ground reference voltage by more than one diode forward voltage drop.

The resonant tank circuit 140 further includes a resonant circuit capacitor 150 and the primary winding 162 of an output transformer 160. A first terminal of the primary winding is connected to the resonant tank node 148. A second terminal of the primary winding is connected to a first terminal of the resonant circuit capacitor. A second terminal of the resonant circuit capacitor is connected to the input ground reference 114.

The output transformer 160 includes a center-tapped secondary winding 170 having a first winding half 172, a second winding half 174 and a center tap 176. The first winding half 172 is connected between the center tap and a first secondary output terminal 180. The second winding half 174 is connected between the center tap and a second secondary output terminal 182. The center tap 176 is connected to an output ground reference 184. The output ground reference is isolated from the input ground reference 114 by the output transformer. Accordingly, the output transformer may also be referred to as an isolation transformer.

The first secondary output terminal 180 of the output transformer 160 is connected to the anode of a first rectifier diode 190. The second secondary output terminal 182 is connected to the anode of a second rectifier diode 192. The cathodes of the two rectifier diodes are connected together at an output node 194. A filter capacitor 196 is connected between the output node and the output ground reference 184. A DC load ("LED LOAD") 198 is connected across the filter capacitor between the output node and the output ground reference. In the illustrated embodiment, the DC load includes a plurality of light-emitting diodes (LEDs) connected in series or connected in a series-parallel combination.

In operation, the switched DC voltage on the common switching node 122 is AC-coupled to the primary winding 162 of the output transformer 160. Accordingly, an AC voltage is produced on the secondary winding 170 of the output transformer. The AC output of the secondary winding is rectified by the two rectifier diodes 190, 192 to produce a DC voltage ($V_{LED}$) across the filter capacitor 196 to drive the LEDs of the DC load 198.

In the conventional resonant tank circuit 140 illustrated in FIG. 1, the resonant circuit inductor 142 and the output transformer 160 are two entirely separate magnetic components. For example, FIG. 2 illustrates a conventional resonant inductor 142. FIG. 3 illustrates an exploded view of the resonant inductor. As illustrated, the resonant inductor includes a bobbin 200 having a coil 202 wound around a central passage 204. A first E-core 210 of the inductor has a center leg 212 inserted into the central passage from a first end of the bobbin. The first E-core has a first outer leg 214 and a second outer leg 216 positioned on opposed sides of the bobbin. A second E-core 220 of the inductor has a center leg 222 inserted into the central passage from a first end of the bobbin. The second E-core has a first outer leg 224 and a second outer leg 226 positioned on opposed sides of the bobbin. The bobbin further includes a first pin rail 230 and a second pin rail 232 at opposed ends of the bobbin. Each pin rail supports a plurality of pins 234. The ends of the winding (not shown) of the coil are connected to selected pins on one or both of the pin rails. For example, in a conventional inductor having a single coil winding, a first end of the winding is connected to a pin on the first pin rail and a second end of the winding is connected to a pin on the second pin rail. Alternatively, both ends of the winding can be connected to respective pins on the same pin rail.

FIG. 4 illustrates a conventional output transformer 160. FIG. 5 illustrates an exploded view of the output transformer. As illustrated, the transformer includes a bobbin 240 having a coil 242 wound around a central passage 244. A first E-core 250 of the transformer has a center leg 252 inserted into the central passage from a first end of the bobbin. The first E-core has a first outer leg 254 and a second outer leg 256 positioned on opposed sides of the bobbin. A second E-core 260 of the transformer has a center leg 262 inserted into the central passage from a first end of the bobbin. The second E-core has a first outer leg 264 and a second outer leg 266 positioned on opposed sides of the bobbin. The bobbin further includes a first pin rail 270 and a second pin rail 272 at opposed ends of the bobbin. Each pin rail supports a plurality of pins 274. The ends of the windings (not shown) of the coil are connected to selected pins on one or both of the pin rails. For example, in a conventional transformer, the two ends of the primary winding may be connected to respective pins on the first pin rail, and the two end terminals and the center tap of the secondary winding may be connected to three pins on the second pin rail.

As shown in FIGS. 2-5, each of the inductor 140 and the output transformer 160 occupies a respective surface area defined by the spacing between the respective first and second pin rails, the widths of the pin rails and spacing required between adjacent components. For example, FIG. 6 illustrates a first plan view of the inductor and transformer positioned longitudinally with respect to each other on a typical printed circuit board with a minimal spacing between the two components. FIG. 7 illustrates the two components positioned laterally with respect to each other. In either configuration, the surface area occupied by the two components is considerably greater than the surface area occupied by the transformer alone or by the inductor alone.

SUMMARY OF THE INVENTION

The invention disclosed herein provides a solution to reduce the surface area for two magnetic components. One aspect of the invention is a magnetic assembly that includes a single bobbin structure that supports a first coil and a second coil. A first E-core has a center leg positioned within the first coil. A second E-core has a center leg positioned within the second coil. An I-core is positioned between the first E-core and the second E-core. The I-core completes a first set of magnetic paths between the center leg and outer legs of the first E-core and also completes a second set of magnetic paths between the center leg and outer legs of the second E-core. The two E-cores and the I-core are stacked in a vertical E-I-E configuration with respect to a common set of pin rails. In one embodiment, the first coil and the first E-core are configured as a transformer; and the second coil and the second E-core are configured as an inductor.

Another aspect of the invention is a magnetic assembly that combines two magnetic device functions in a single unified structure. The magnetic assembly includes a bobbin structure having a first core passage, a second core passage and a third core passage. The third core passage is positioned between the first core passage and the second core passage. A first coil at least partially surrounds the first core passage. A second coil at least partially surrounds the second core passage. An I-core has at least a central portion positioned in the third core passage. A first E-core has a center leg positioned in the first core passage and has a first outer leg and a second outer leg. The first and second outer legs of the first E-core have respective end surfaces contacting the I-core. A second E-core has a center leg positioned in the second core passage and has a first outer leg and a second outer leg. The first and second outer legs and the center leg of the second E-core have respective end surfaces positioned proximate to and spaced apart from the I-core.

In certain embodiments, the center leg of the first E-core is shorter than the outer legs of the first E-core such that the end surface of the center leg of the first E-core is spaced apart from the first planar surface of the I-core by a selected gap distance.

In certain embodiments, a gap spacer is positioned between the I-core and the end surfaces of the first outer leg, the second outer leg and the center leg of the second E-core. The gap spacer has a thickness selected to provide a predetermined gap spacing between the end surfaces of the first outer leg, the second outer leg and the center leg of the second E-core and the I-core.

In certain embodiments, the first coil, the first E-core and at least a first portion of the I-core comprise a first inductive device; and the second coil, the second E-core and at least a second portion of the I-core comprise a second inductive device.

In certain embodiments, the first inductive device is a transformer; and the second inductive device is an inductor.

Another aspect of the invention is a bobbin for a magnetic assembly. The bobbin includes a first flange, a second flange, a third flange and a fourth flange. A first winding portion is positioned between the first flange and the second flange. A second winding surface is positioned between the third flange and the fourth flange. An I-core receiving passage is positioned between the second flange and the third flange. A first core leg receiving passage extends from the first flange to the second flange. A second core leg receiving passage extends from the fourth flange to the third flange.

In certain embodiments, the first core passage and the second core are aligned along a first passage direction; and the third core passage is oriented orthogonally to the first core passage and the second core passage.

Another aspect of the invention is a magnetic assembly. The magnetic assembly includes a bobbin structure. The bobbin structure includes a first flange and a second flange. The second flange is parallel to the first flange and is displaced away from the first flange. A first core passage extends from the first flange to the second flange. The first core passage is perpendicular to the first flange and the second flange. A first winding surface surrounds the first core passage between first flange and the second flange. A third flange is parallel to the second flange and is displaced away from the second flange. The third flange is coupled to the second flange by at least one spacer wall to define an I-core receiving slot between the second flange and the third flange. A fourth flange is parallel to the third flange and is displaced away from the third flange. A second core passage extends from the third flange to the fourth flange. The second core passage is perpendicular to the third flange and the fourth flange. A second winding surface surrounds the second core passage between the third flange and the fourth flange. A least a first coil is wound around the first winding surface. At least a second coil is wound around the second winding surface. A first E-core has a respective first outer leg, a respective second outer leg and a respective center leg. Each leg of the first E-core has a respective end surface. The center leg of the first E-core inserted into the first core passage with the end surface of the center leg positioned proximate to the second flange. A second E-core has a respective first outer leg, a respective second outer leg and a respective center leg. Each leg has a respective end surface. The center leg of the second E-core is inserted into the second core passage with the end surface of the center leg positioned proximate to the third flange. An I-core is positioned in the I-core receiving slot. The I-core has a first planar side positioned against the end surfaces of the first outer leg and the second outer leg of the first E-core. The I-core has a second planar side positioned proximate to and spaced apart from the end surfaces of the first outer leg, the second outer leg and the center leg of the second E-core.

In certain embodiments, the magnetic assembly further includes a gap spacer positioned between the second planar side of the I-core and the end surfaces of the first outer leg, the second outer leg and the center leg of the second E-core. The gap spacer has a thickness selected to provide a predetermined gap spacing between the end surfaces of the first outer leg, the second outer leg and the center leg of the second E-core and the second planar side of the I-core.

In certain embodiments, the gap spacer includes a polyester film material having a thickness selected to provide the predetermined gap. For example, the thickness of the gap spacer may be in a range between 0.0025 inch and 0.0200 inch. In certain embodiments, the gap spacer includes a polyethylene terephthalate (PET) film.

In certain embodiments, the center leg of the first E-core is shorter than the outer legs of the first E-core such that the end surface of the center leg of the first E-core is spaced apart from the first planar surface of the I-core by a selected gap distance.

In certain embodiments, the first coil, the first E-core and at least a first portion of the I-core comprise a first inductive device; and the second coil, the second E-core and at least a second portion of the I-core comprise a second inductive device.

In certain embodiments, the first inductive device is a transformer; and the second inductive device is an inductor.

DETAILED DESCRIPTION OF THE INVENTION

Figure 1:
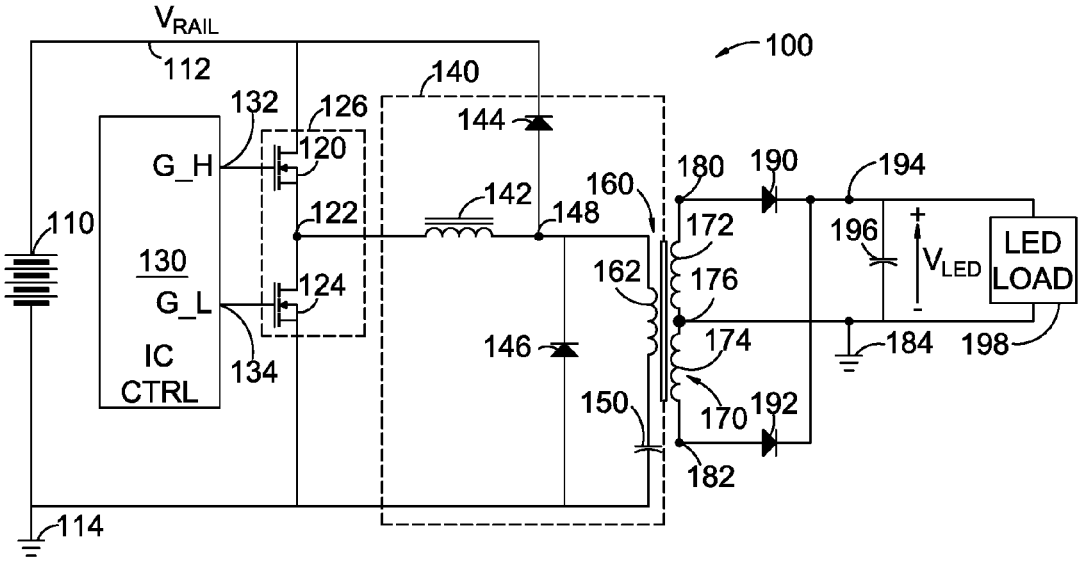
Fig. 1 (Prior Art)
FIG. 1 illustrates a circuit diagram showing a DC-DC converter as conventionally known in the art.
Figure 2:
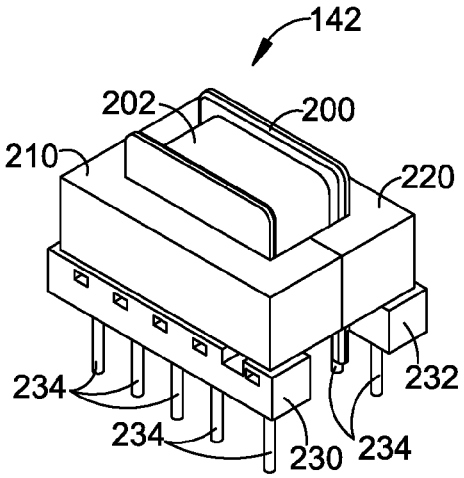
FIG. 2 (Prior Art)
FIG. 2 illustrates a perspective view of a conventional inductor.
Figure 3:
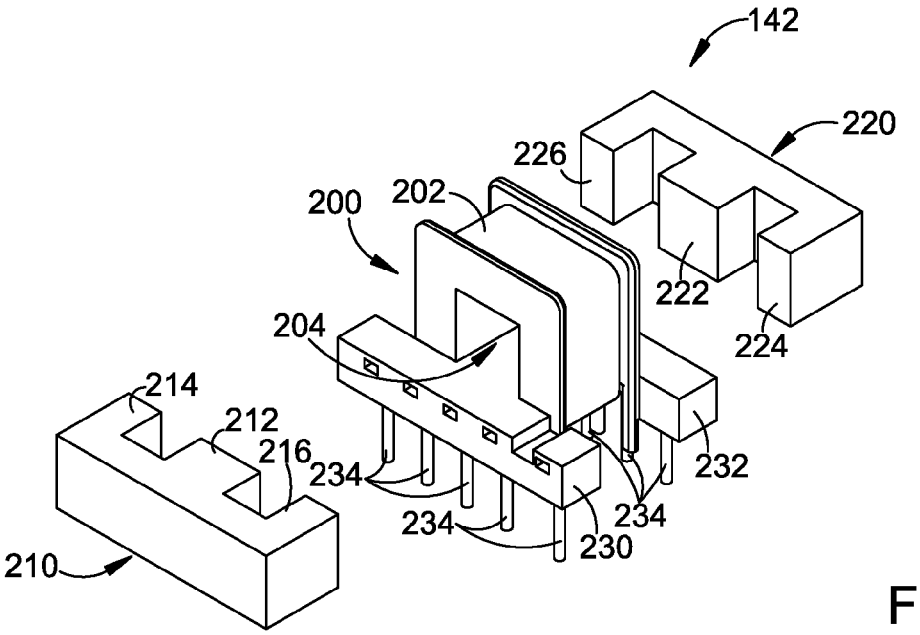
FIG. 3 (Prior Art)
FIG. 3 illustrates an exploded perspective view of the inductor of FIG. 2.
Figure 4:
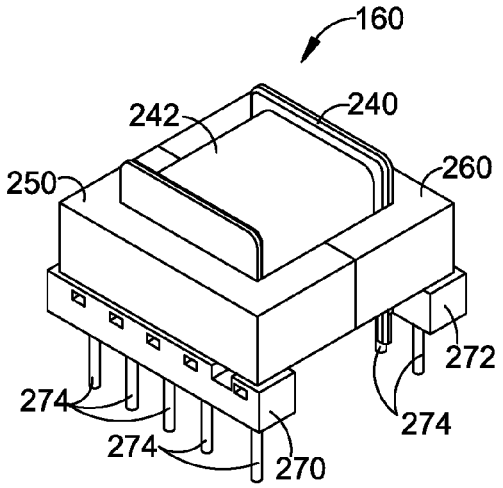
FIG. 4 (Prior Art)
FIG. 4 illustrates a perspective view of a conventional output transformer.
Figure 5:
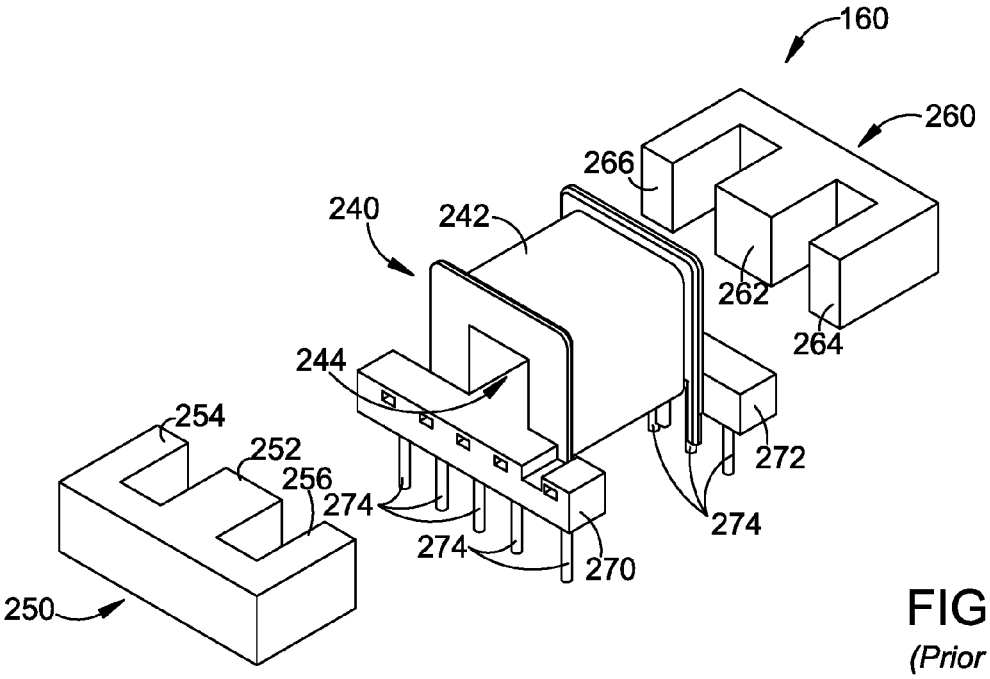
FIG. 5 (Prior Art)
FIG. 5 illustrates an exploded perspective view of the transformer of FIG. 2.
Figure 6:
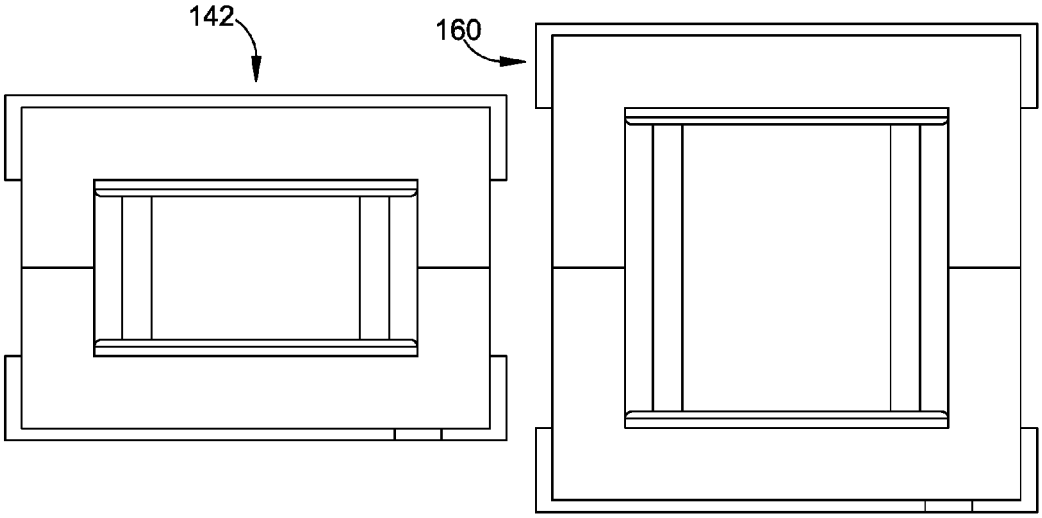
FIG. 6 (Prior Art)
FIG. 6 illustrates a plan view of the inductor of FIG. 2 and the output transformer of FIG. 4 positioned on a printed circuit board in a longitudinal relationship.
Figure 7:
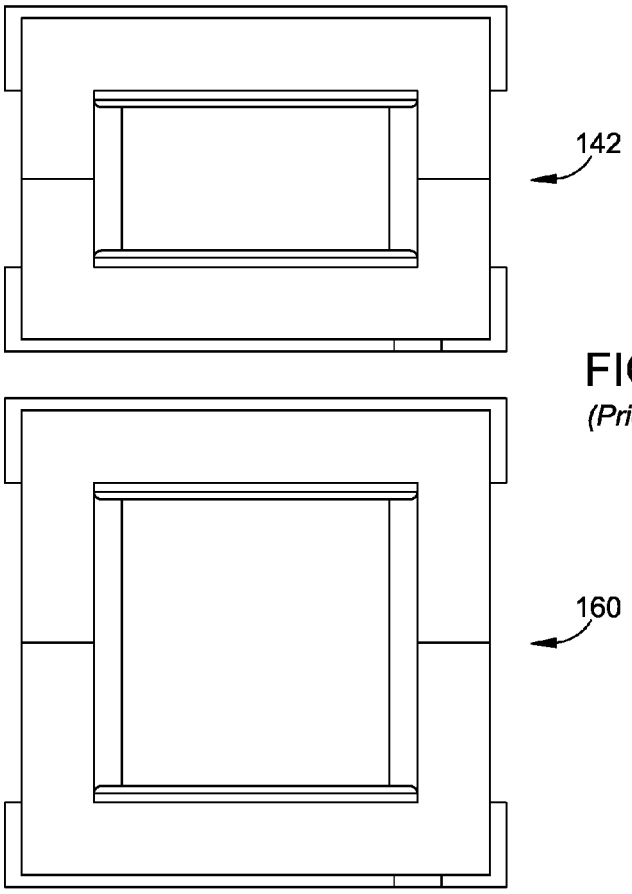
FIG. 7 (Prior Art)
FIG. 7 illustrates a plan view of the inductor of FIG. 2 and the output transformer of FIG. 4 positioned on a printed circuit board in a lateral relationship.
Figure 8:
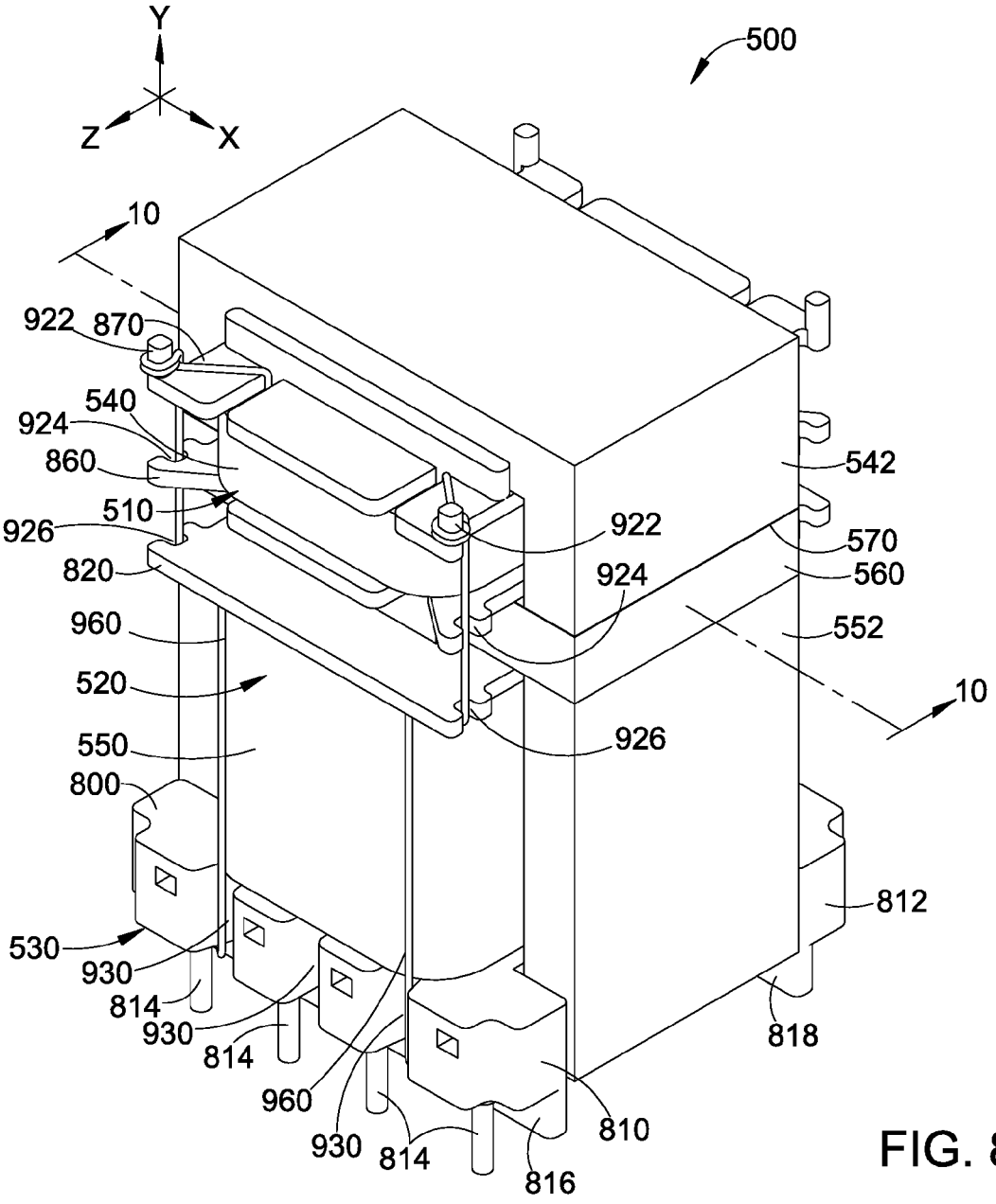
FIG. 8 illustrates a perspective view of a combined magnetic assembly with an inductor and an output transformer sharing a single bobbin, the view referenced to X-, Y-, and Z-axes.

An exemplary invention to the problem disclosed in FIGS. 1-7 is illustrated by a combined magnetic assembly 500 in FIGS. 8-24.

FIGS. 8-11 illustrate views of the combined magnetic assembly 500 with a resonant inductor 510 and an output transformer 520 sharing a single bobbin 530. In the drawings, the X-axis, Y-axis and Z-axis are shown for reference to assist in visualizing the orientations of the structures.

The inductor 510 and the transformer 520 are installed in the bobbin 530 with the inductor "stacked" on top of the transformer. The inductor includes an inductor coil 540 positioned around a first (upper) portion of the bobbin. The inductor further includes an inductor E-core 542 positioned with respect to the inductor coil. The transformer includes a transformer coil 550 positioned around a second (lower) portion of the bobbin. The transformer further includes a transformer E-core 552 positioned with respect to the transformer coil. The inductor and the transformer share a common I-core 560 positioned between the two E-cores as described below. The two E-cores and the I-core comprise a suitable ferromagnetic material such as, for example, silicon steel, a ferrite material, or other suitable material. In the illustrated embodiment, a gap spacer 570 is positioned between the I-core and the inductor E-core.

Figure 12:
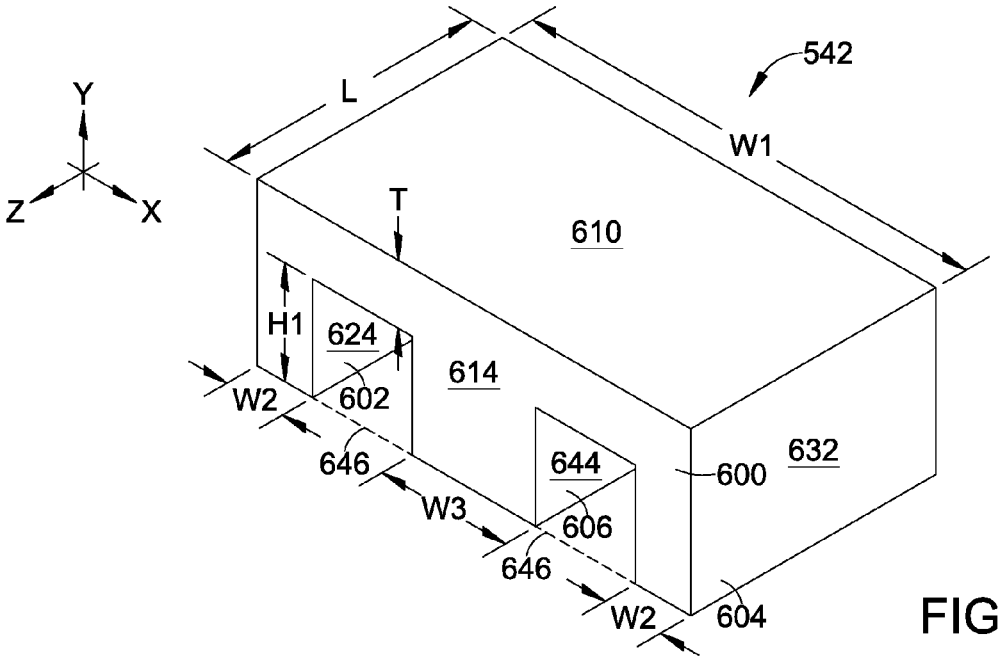
FIG. 12 illustrates a perspective view of the inductor E-core of the magnetic assembly as oriented in FIG. 8, the view referenced to the X-, Y-, and Z-axes of FIG. 8.
Figure 13:
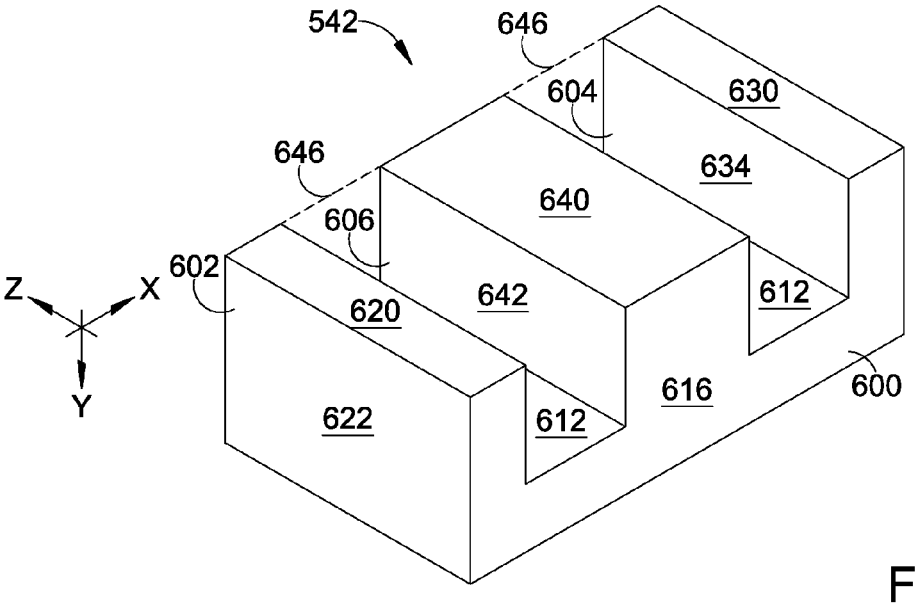
FIG. 13 illustrates the inductor E-core of FIG. 12 flipped 180 degrees about the X-axis and then rotated 90 degrees about the Z-axis to show the surfaces hidden in FIG. 12.

As shown in FIGS. 12 and 13, the E-core 542 of the inductor 510 includes a main body 600, a first outer leg 602, a second outer leg 604 and a center leg 606. The main body has an outer surface 610 and an inner surface 612. As illustrated, the outer surface has a length L (in a direction parallel to the Z-axis) and a width W1 (in a direction parallel to the X-axis). The main body has a thickness T (in a direction parallel to the Y-axis) between the inner surface and the outer surface. The three legs extend perpendicularly from the inner surface. The main body and the three legs have a first (front) common side surface 614 and a second (rear) common side surface 616.

The first outer leg 602 of the inductor E-core 542 extends from the inner surface 612 of the main body 600 of the E-core to a first outer leg end surface 620. The first outer leg has an outer lateral surface 622 and an inner lateral surface 624. The first outer leg has a width W2 between the two lateral surfaces.

The second outer leg 604 of the inductor E-core 542 extends from the inner surface 612 of the main body 600 of the E-core to a second outer leg end surface 630. The second outer leg has an outer lateral surface 632 and an inner lateral surface 634. In the illustrated embodiment, the second outer leg also has the width W2 between the two lateral surfaces corresponding to the width of the first outer leg 602.

The center leg 606 of the inductor E-core 542 extends from the inner surface 612 of the main body 600 of the E-core to a center leg end surface 640. The center leg has a first lateral surface 642 that faces the inner lateral surface 624 of the first outer leg 602 and has a second lateral surface 644 that faces the inner lateral surface 634 of the second outer leg 604. The center leg has a width W3 between the two lateral surfaces. In the illustrated embodiment, the width W3 of the center leg may be approximately twice the width W2 of the two outer legs.

In the illustrated embodiment, the center leg 606 of the inductor E-core 542 has substantially the same length as the lengths of the two outer legs 602, 604 of the inductor E-core with respect to the inner surface 612 of the main body 600 of the inductor E core such that the respective end surfaces of the three legs are aligned. The alignment is indicated by a dashed line 646 that passes through the edges of the three end surfaces. The end surfaces of the three legs are spaced apart from the inner surface of the main body of the inductor E-core by a first height H1.

Figure 14:
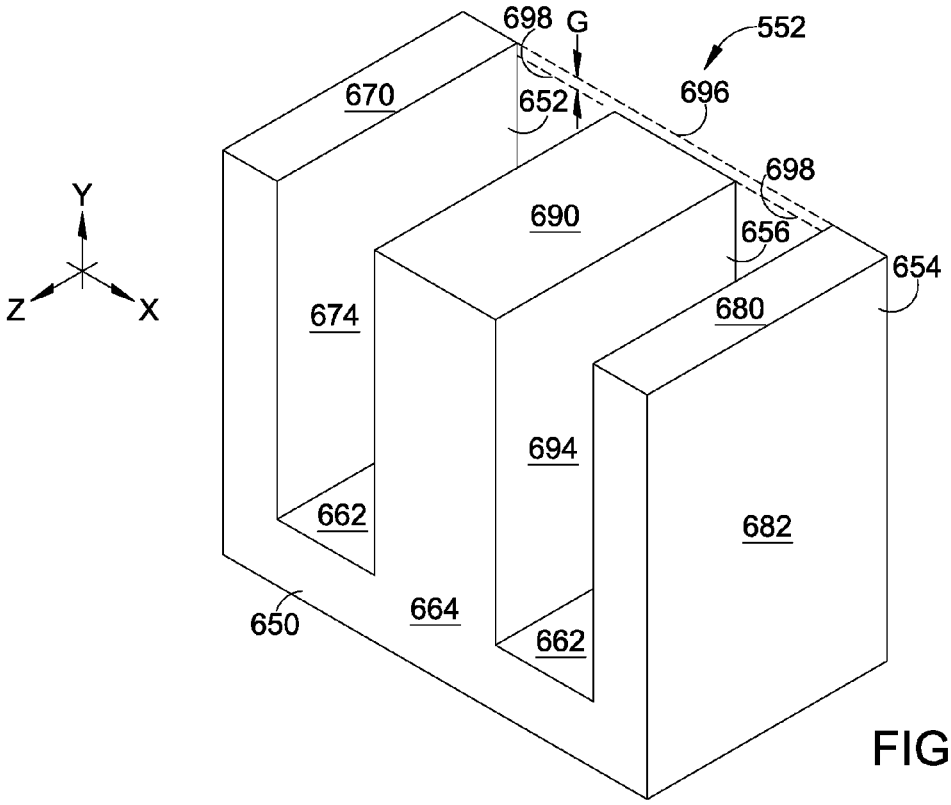
FIG. 14 illustrates a perspective view of the transformer E-core of the magnetic assembly as oriented in FIG. 8, the view referenced to the X-, Y-, and Z-axes of FIG. 8.
Figure 15:
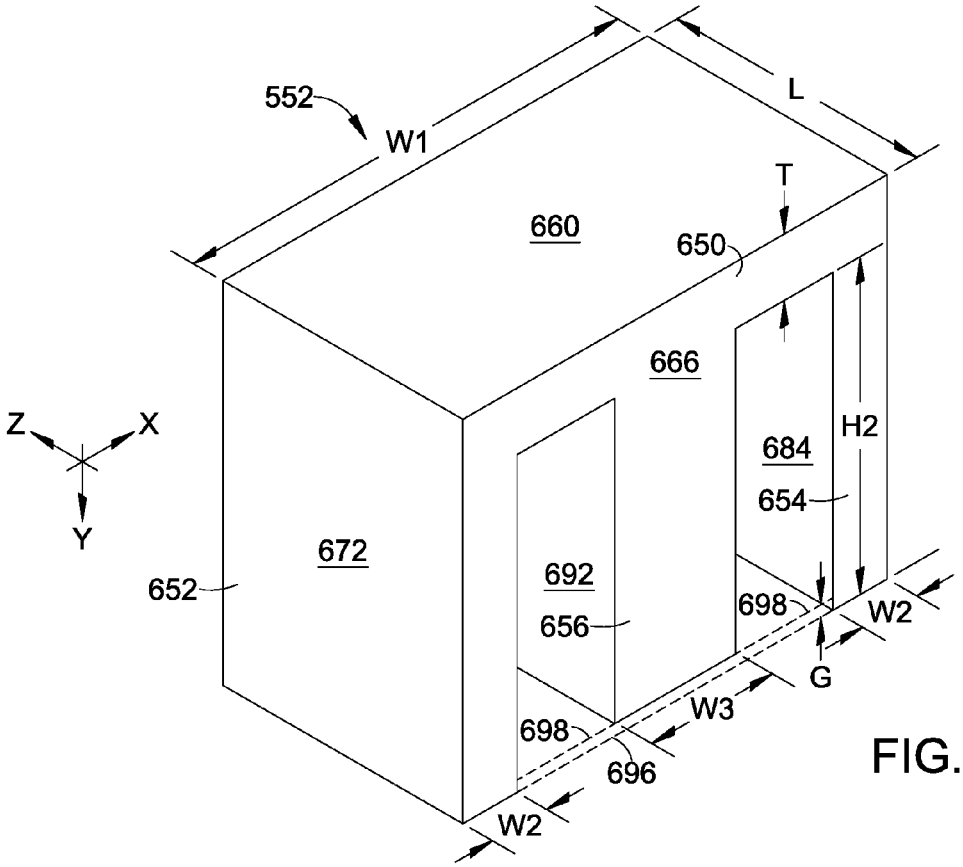
FIG. 15 illustrates the transformer E-core of FIG. 14 flipped 180 degrees about the X-axis and then rotated 90 degrees about the Z-axis to show the surfaces hidden in FIG. 14.

As shown in FIGS. 14 and 15, the E-core 552 of the transformer 520 includes a main body 650, a first outer leg 652, a second outer leg 654 and a center leg 656. The main body has an outer surface 660 and an inner surface 662. As illustrated, the outer surface has the length L and the width W1 corresponding to the length and width of the outer surface 610 of the main body 600 of the inductor E-core 542. In the illustrated embodiment, the main body of the transformer E-core may have the same thickness T between the inner surface and the outer surface as the thickness of the main body of the inductor E-core. The three legs extend perpendicularly from the inner surface. The main body and the three legs of the transformer E-core have a first (front) common side surface 664 and a second (rear) common side surface 666.

The first outer leg 652 of the transformer E-core 552 extends from the inner surface 662 of the main body 650 to a first outer leg end surface 670. The first outer leg has an outer lateral surface 672 and an inner lateral surface 674. In the illustrated embodiment, the first outer leg has the width W2 between the two lateral surfaces corresponding to the width of the first outer leg 602 of the inductor E-core 510.

The second outer leg 654 of the transformer E-core 552 extends from the inner surface 662 of the main body 650 of the E-core to a second outer leg end surface 680. The second outer leg has an outer lateral surface 682 and an inner lateral surface 684. In the illustrated embodiment, the second outer leg also has the width W2 between the two lateral surfaces corresponding to the width of the first outer leg 652.

The center leg 656 of the transformer E-core 552 extends from the inner surface 662 of the main body 650 of the E-core to a center leg end surface 690. The center leg has a first lateral surface 692 that faces the inner lateral surface 674 of the first outer leg 652 and has a second lateral surface 694 that faces the inner lateral surface 684 of the second outer leg 654. In the illustrated embodiment, the center leg has the width W3 between the two lateral surfaces corresponding to the width of the center leg 606 of the inductor E-core 510.

In the illustrated embodiment, the lengths of the two outer legs 652, 654 of the transformer E-core 552 with respect to the inner surface 662 of the main body 650 of the transformer E-core are substantially the same such that the respective end surfaces of the two outer legs are aligned as indicated by a first dashed line 696 that passes through the edges of the two end surfaces. Thus, the end surfaces of the two outer legs are spaced apart from the inner surface of the main body of the transformer E-core by a second height H2.

In the illustrated embodiment, the center leg 656 of the transformer E-core 552 is shorter than the two outer legs 652, 654 with respect to the inner surface 662 of the main body 650 of the transformer E-core as illustrated by a second dashed line 698 that passes through the edge of the end surface of the center leg. The second dashed line is offset from the first dashed line by a gap G. The difference in length (e.g., the gap G) may be exaggerated in FIGS. 14 and 15 for the purpose of illustrating the difference. For example, the gap may range from 0.001 inch to 0.05 inch).

In the illustrated embodiment, the outer legs 602, 604 of the inductor E-core 542 are shorter than the outer legs 652, 654 of the transformer E-core 552; however, in other embodiments, the outer legs of the inductor E-core may be as long as or may be longer than the outer legs of the transformer E-core. The lengths of the outer legs of the E-cores of the inductor and the transformer are determined in part by the lengths of the respective coil windings.

In the illustrated embodiment, the center legs 606, 656 of the two E-cores 542, 552 have rectangular cross sections; however, in other embodiments, the center legs may be configured to have other cross sections (e.g., circular cross sections).

Figure 16:
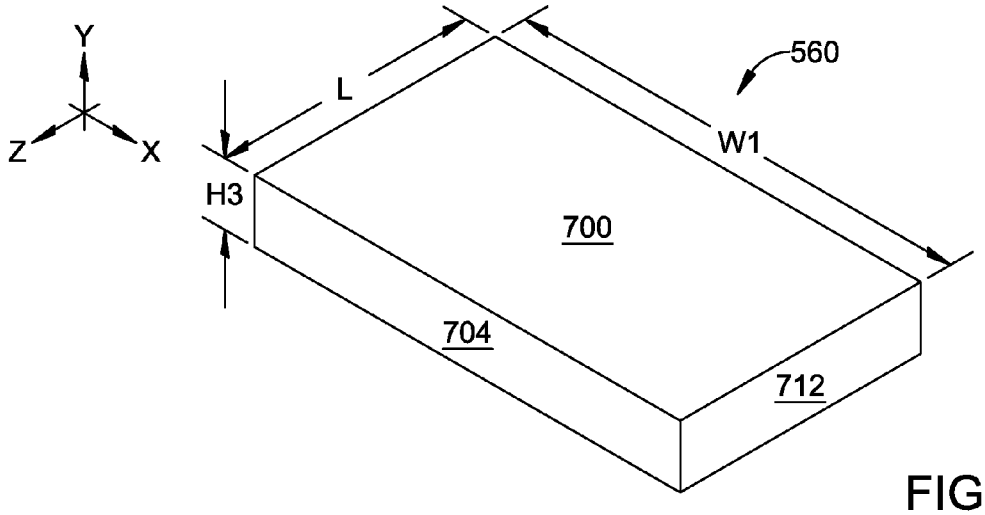
FIG. 16 illustrates a perspective view of the I-core of the magnetic assembly as oriented in FIG. 8, the view referenced to the X-, Y-, and Z-axes of FIG. 8.
Figure 17:
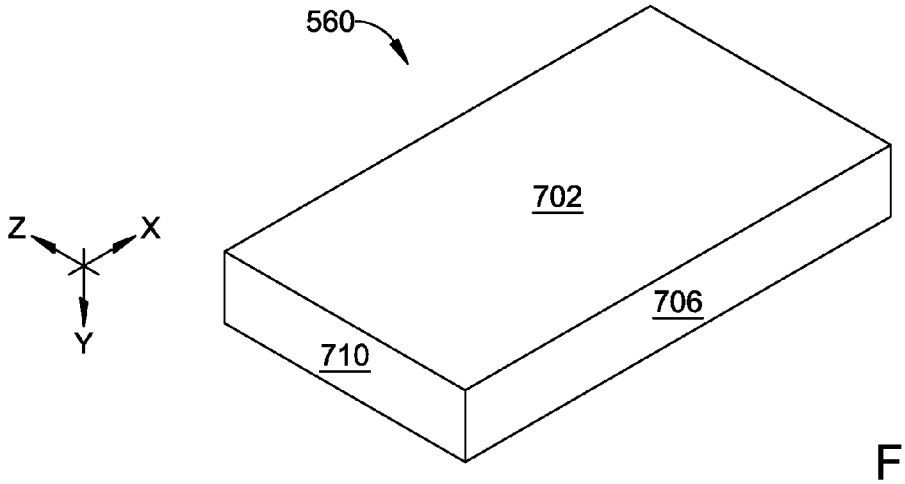
FIG. 17 illustrates the I-core of FIG. 21 flipped 180 degrees about the X-axis and then rotated 90 degrees about the Z-axis to show the surfaces hidden in FIG. 16.

As illustrated in FIGS. 16 and 17, the I-core 560 is a regular parallelepiped having a first (upper) major planar surface 700 and a second (lower) major planar surface 702. The two major surfaces have the length L and the width W1 corresponding to the lengths and the widths of the outer surfaces 610, 660, respectively, of the inductor E-core 542 and the transformer E-core 552. The two major surfaces are spaced apart by a height H3 to form a first (front) lateral surface 704 and a second (rear) lateral surface 706 along the width of the two major surfaces and to form a first end surface 710 and a second end surface 712 along the length of the two major surfaces. In the illustrated embodiment, the height H3 of the I-core is similar to the thickness T of the main bodies 600, 650 of the two E-cores; however, the thickness of the I-core may be greater or less than the main body thicknesses in other embodiments.

Figure 11:
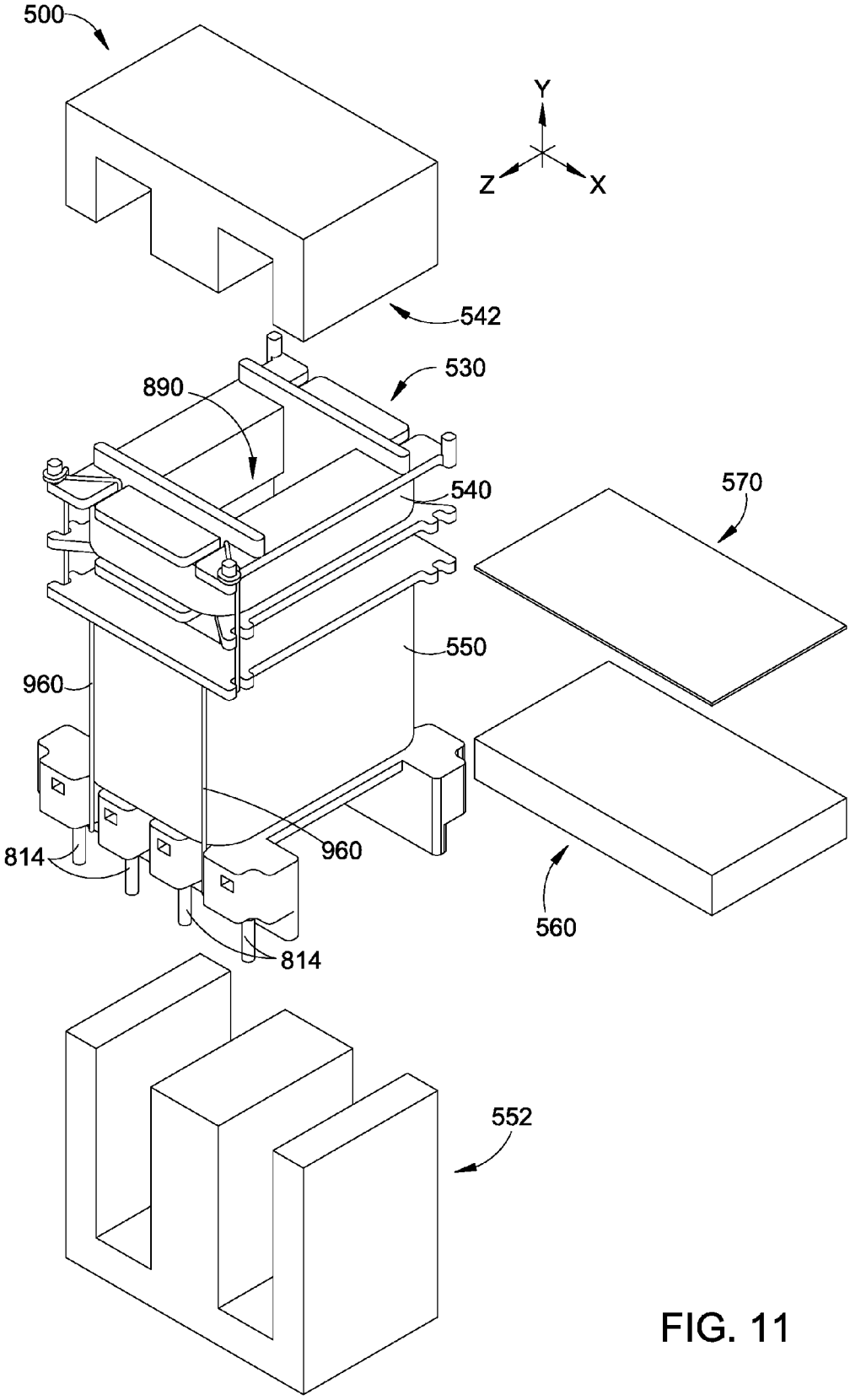
FIG. 11 illustrates an exploded perspective view of the combined magnetic assembly of FIG. 8.

As shown in the exploded view of FIG. 11, the gap spacer 570 includes a relatively thin material having planar surfaces (one shown) generally corresponding to the shape and size of the two planar surfaces 700, 702 of the I-core 560. For example, in one embodiment, the gap spacer comprise a polyester film material (e.g., a Mylar® polyethylene terephthalate (PET) film) having a thickness of between 0.0025 inch to 0.0200 inch). As discussed below, the thickness of the gap spacer is selected to provide a desired gap distance between the legs 602, 604, 606 of the inductor E-core 542 and the upper planar surface 700 of the I-core.

As shown in FIGS. 19-23, the bobbin 530 includes a first (lower) flange 800. The first flange has a lowermost surface 802 and an uppermost surface 804. The first flange supports a first pin rail 810 and a second pin rail 812. Each pin rail has a plurality of pins 814 extending downward from the respective pin rail perpendicular to the first flange. The first pin rail includes a first lower channel wall 816 that extends from the lowermost surface of the first flange. The second pin rail includes a second lower channel wall 818 that also extends from the lowermost surface of the first flange. In the illustrated embodiment, each lower channel wall extends downward from the lowermost surface of the first flange by a height H4. The height is selected to be at least as great as the thickness T of the main body 650 of the transformer E-core 552. The channel walls also serve as standoffs. When the magnetic assembly 500 is installed on a printed circuit board (not shown), only a lowermost portion of each pin is inserted into through-holes in the printed circuit board. Thus, an uppermost portion of each pin is available to receive wiring without interfering with the later installation of the magnetic assembly.

Figure 18:
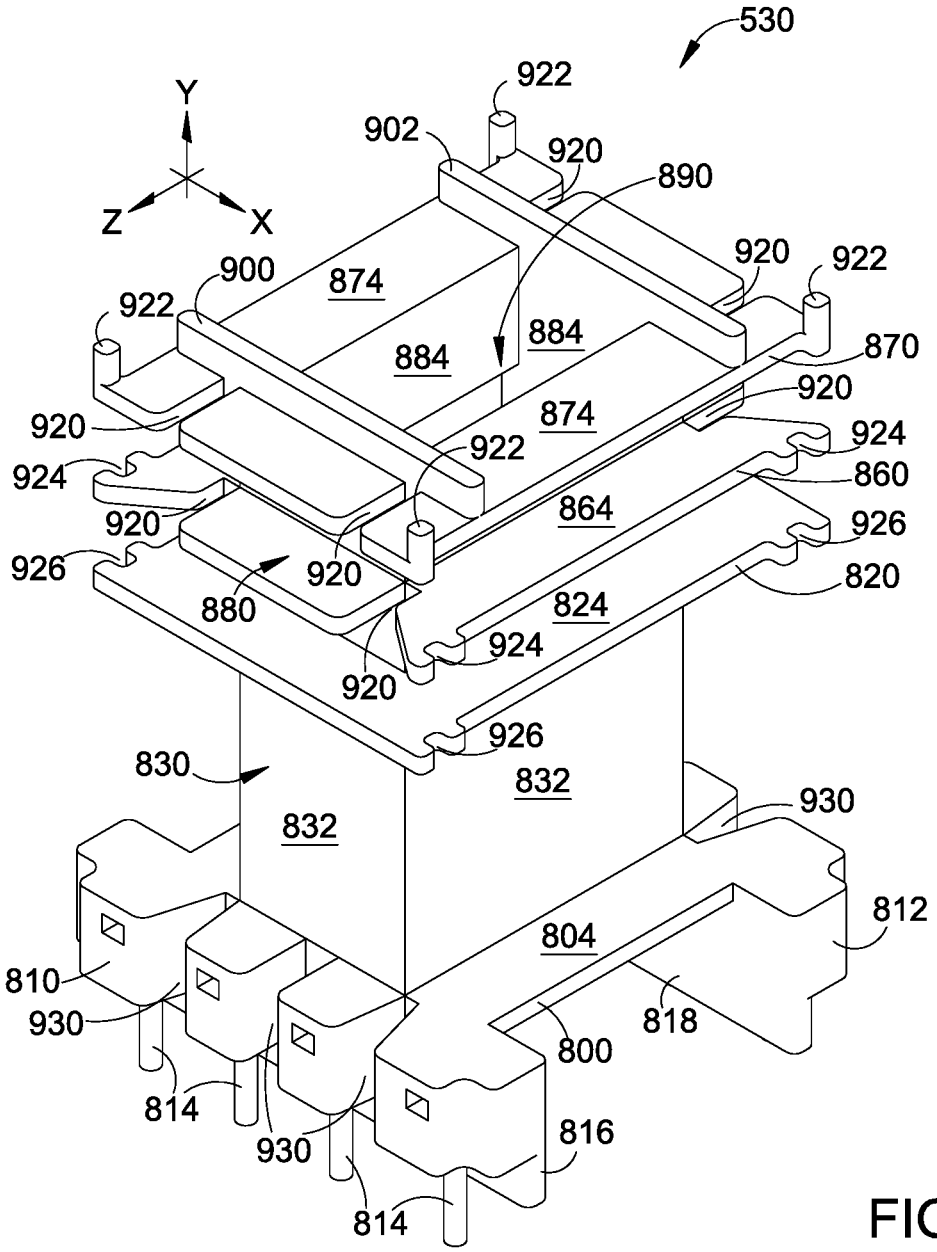
FIG. 18 illustrates a perspective view of the bobbin of the combined magnetic assembly of FIG. 8 prior to installation of the coils and prior to insertion of the cores, the view referenced to the X-, Y-, and Z-axes of FIG. 8.
Figure 19:
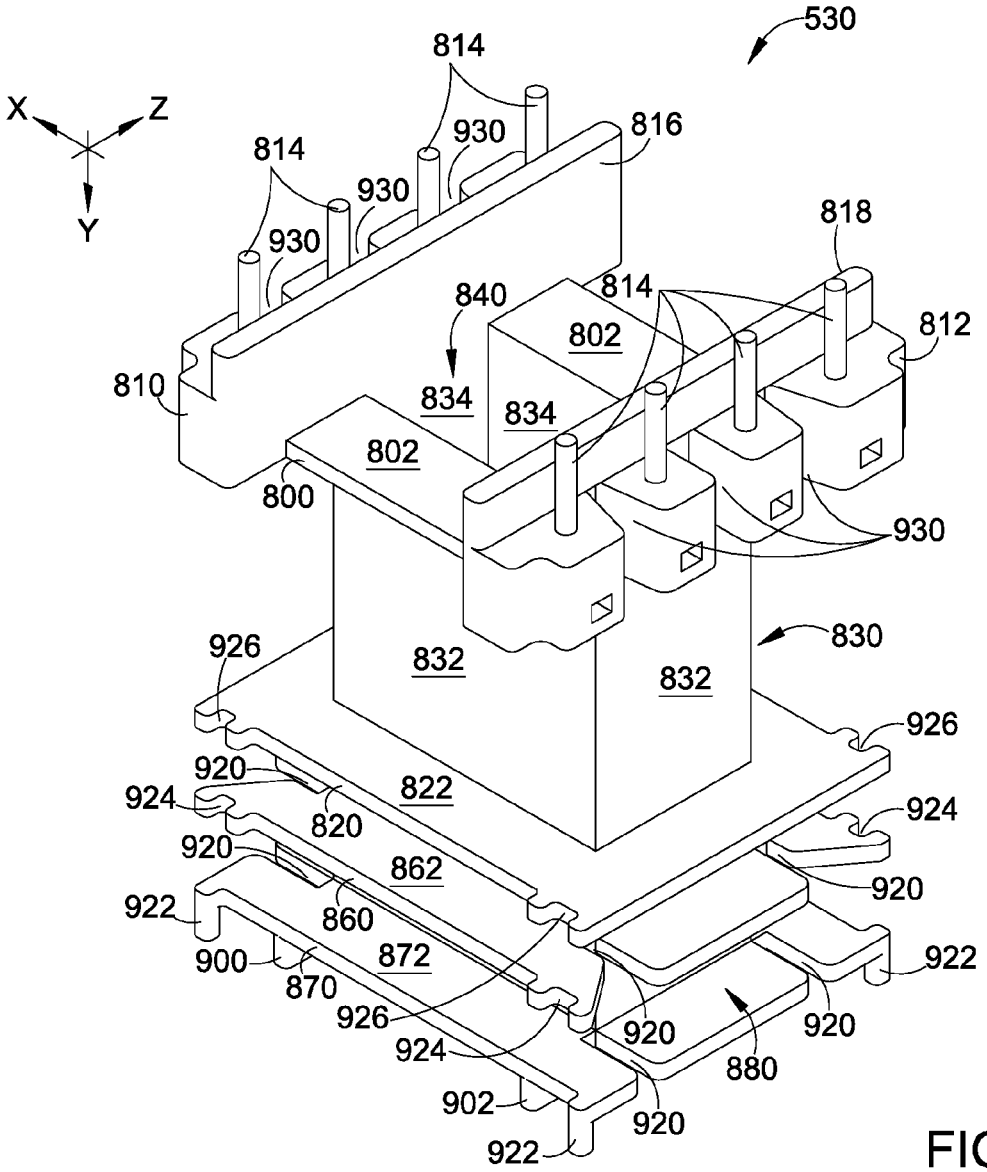
FIG. 19 illustrates a perspective view of the bobbin of FIG. 18 flipped 180 degrees about the X-axis and then rotated 180 degrees about the Z-axis with respect to the view in FIG. 18.
Figure 20:
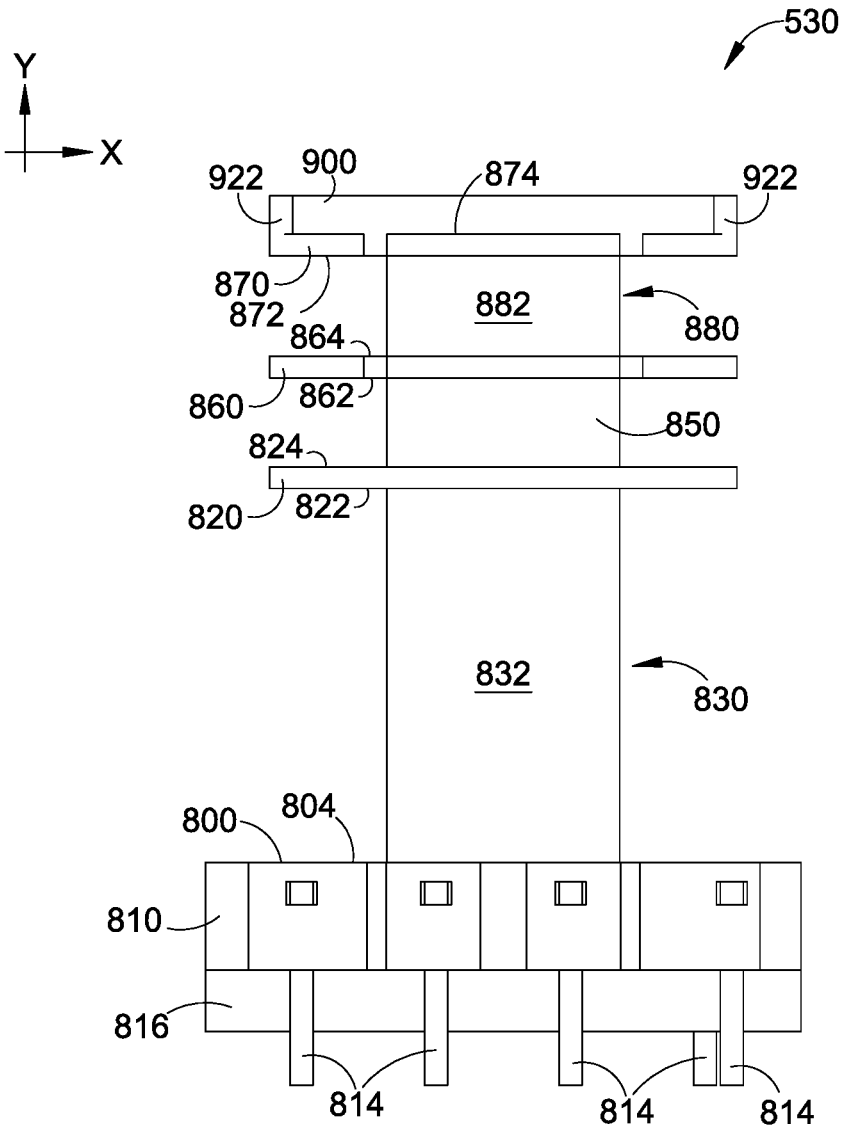
FIG. 20 illustrates a front elevational view of the bobbin of FIG. 18.
Figure 21:
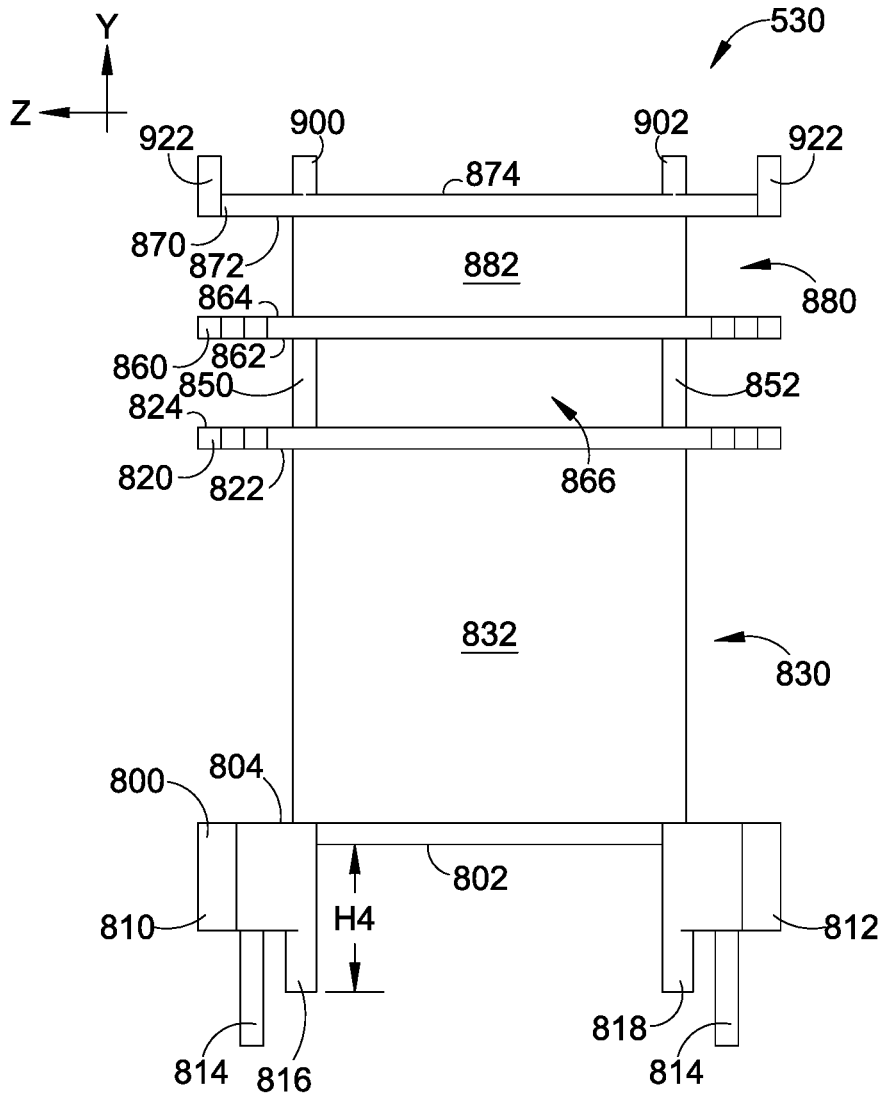
FIG. 21 illustrates a right elevational view of the bobbin of FIG. 18.
Figure 22:
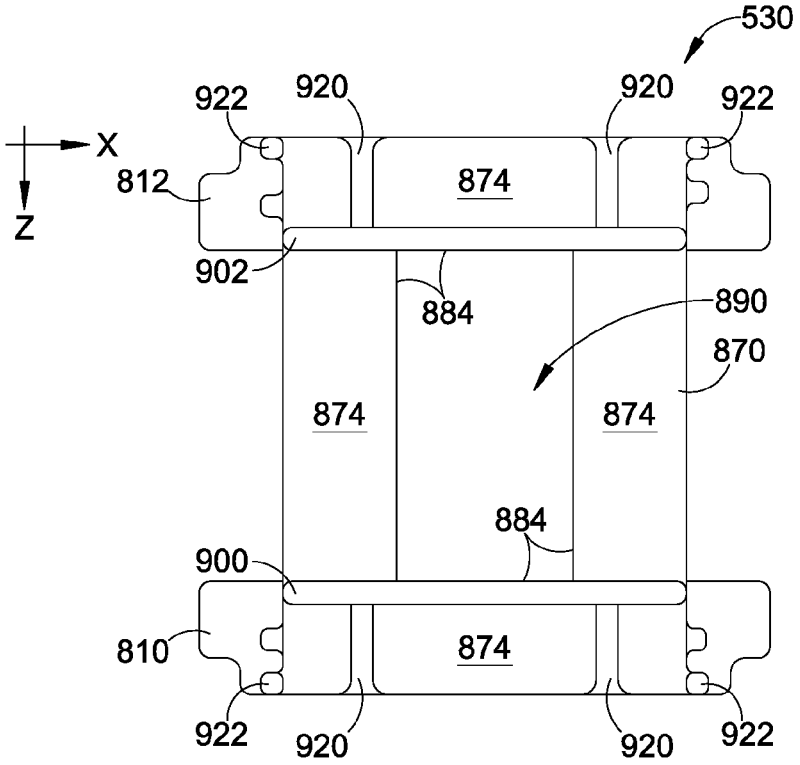
FIG. 22 illustrates a top plan view of the bobbin of FIG. 18.
Figure 23:
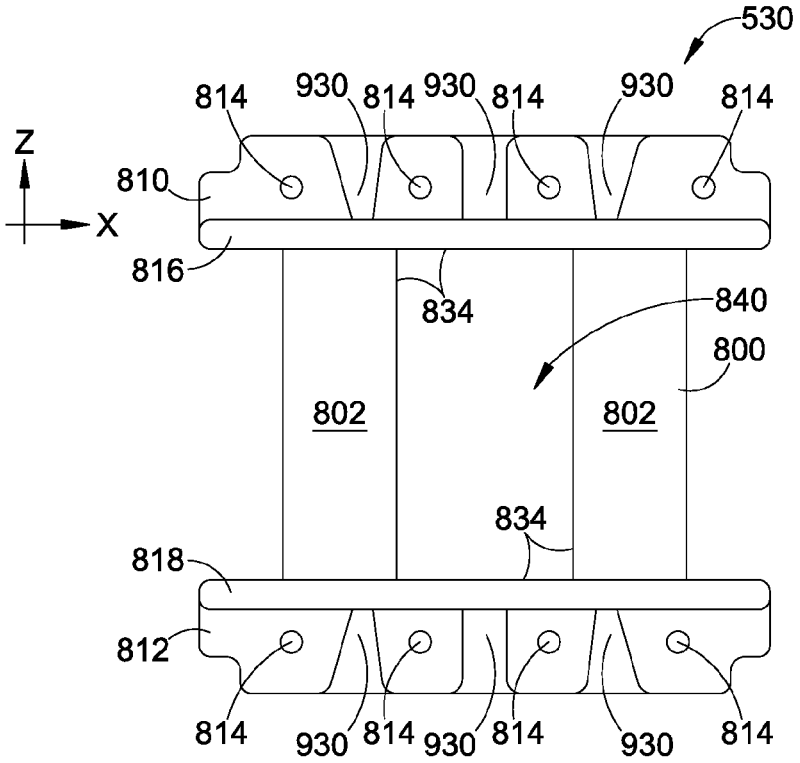
FIG. 23 illustrates a bottom plan view of the bobbin of FIG. 18.

For the purposes of the following discussion the first pin rail 610 is located at the front of the bobbin 530 and extends from the left side to the right side of the bobbin as positioned in FIGS. 18 and 20. The second pin rail 612 is located at the rear of the bobbin and is parallel to the first pin rail.

A second flange 820 is spaced apart vertically from the first flange 800. The second flange has a lowermost surface 822 that faces the first flange and has an uppermost surface 824 that faces away from the first flange (e.g., upward when the bobbin is positioned as shown in the drawings). A first winding portion 830 is defined between the uppermost surface 804 of the first flange and the lowermost surface of the second flange. In the illustrated embodiment, the first winding portion is defined by four rectangular outer surfaces 832. Corresponding inner surfaces 834 define a first passage 840 (FIG. 19) between the lowermost surface of the first flange and the uppermost surface of the second flange. The outer surfaces define the base of the first winding portion onto which the first layer of the transformer coil 550 is wound. In the illustrated embodiment, the first passage has a rectangular profile to match the profile of the center leg 656 of the transformer E-core 552 described above; however, in other embodiments, the passage may have a different profile (e.g., circular) to match a different profile of the center leg of the transformer E-core. In the illustrated embodiment, the first passage has a width slightly greater than the width W3 of the center leg of the transformer E-core and has a length slightly greater than the length L of the transformer E-core such that the center leg of the transformer E-core fits snugly within the passage when inserted into the passage.

The first passage 840 has a height between the lowermost surface 802 of the first flange 800 to the uppermost surface 824 of the second flange 820 that is substantially the same as the height H2 of the outer legs 652, 654 of the transformer E-core 552 such that when the inner surface 662 of the main body 660 of the transformer E-core is positioned against the lowermost surface of the first flange, the exposed ends of the outer legs are substantially coincident with the uppermost surface of the second flange. To assure a continuous magnetic path between the end surfaces 670, 680 of the first and second outer legs of the transformer E-core and the second (lower) planar surface 702 of the I-core 560, the height of the passage may be slightly shorter than the height H2 of the two outer legs so that at least a short length of each outer leg extends beyond the uppermost surface of the second flange.

A first spacer wall 850 (FIGS. 20 and 21) extends perpendicularly upward from the uppermost surface 824 of second flange 820 along the front of the bobbin 530. A second spacer wall 852 (FIG. 21) also extends perpendicularly upward from the uppermost surface of the second flange along the rear of the bobbin. The first and second spacer walls are parallel to each other and are spaced apart from each other across the length of the first passage 840 such that respective inner surfaces of the spacer walls are coincident with the inner surfaces 834 that define the passage. In the illustrated embodiment, each spacer wall has a width approximately the same as the width of the first passage. Each spacer wall has a common spacer wall height.

The first spacer wall 850 and the second spacer wall 852 extend to a lowermost surface 862 of a third flange 860. The third flange has an uppermost surface 864. The sides of the bobbin between the first spacer wall and the second spacer wall are open to define a horizontally disposed I-core receiving passage (or slot) 866 (FIG. 2) between the two spacer walls and between the second flange 840 and the third flange. The spacer wall height between the second flange and the third flange is slightly greater than the height H3 of the I-core 560 such that the I-core receiving passage accommodates the combined height of the I-core and thickness of the gap spacer 570.

A fourth flange 870 is spaced apart vertically from the third flange 860. The fourth flange has a lowermost surface 872 that faces the third flange and has an uppermost surface 874 that faces away from the third flange (e.g., upward when the bobbin is positioned as shown in FIG. 18). A second winding portion 880 is defined between the uppermost surface of the third flange and the lowermost surface of the fourth flange. In the illustrated embodiment, the second winding portion is defined by four rectangular outer surfaces 882 (one outer surface is shown in each of FIGS. 20 and 21). Corresponding rectangular inner surfaces 884 define a second passage 890 between the lowermost surface of the third flange and the uppermost surface of the fourth flange. The outer surfaces define the base of the second winding portion onto which the first layer of the inductor coil 540 is wound.

The second passage 890 extends through the third flange 860 and the fourth flange 870 from the lowermost surface 862 of the third flange to the uppermost surface 874 of the fourth flange. The second passage is sized to receive the center leg 606 of the inductor E-core 542. In the illustrated embodiment, the second passage has a length in the direction from the front of the bobbin 530 to the rear of the bobbin that is slightly greater than the length L of the center leg of the inductor E-core. The second passage has width in the direction from the left side to the right side of the bobbin that is slightly greater than the width W3 of the center leg of the inductor E-core. If the center leg of the inductor E-core has a different cross section (e.g., a circular cross section), the second passage may be configured to have a corresponding different cross section. If, for example, the second passage has a circular cross section, the second winding surface may be configured to be cylindrical.

The second passage 890 has a height between the lowermost surface 862 of the third flange 860 to the uppermost surface 874 of the fourth flange 870 that is about the same as the height H1 of the three legs 602, 604, 606 of the inductor E-core 542 such that when the inner surface 612 of the main body 600 of the inductor E-core is positioned against the uppermost surface of the fourth flange, the exposed end surfaces 620, 630, 640 of the three legs of the inductor E-core are substantially coincident with the lowermost surface of the third flange. The height of the passage may be slightly less than the height of the three legs to assure that the end surfaces of the three legs are positioned against the gap spacer 570 when the center leg 606 is fully inserted into the passage.

A first inductor core channel wall 900 and a second inductor core channel wall 902 extend perpendicularly from the uppermost surface 874 of the fourth flange 870. In the illustrated embodiment, the first inductor core channel wall is aligned with the first spacer wall 850. The second inductor core channel wall is aligned with the second spacer wall 852. Accordingly, the two inductor core channel walls are mutually parallel with each other and are spaced apart across the length of the second passage 890 by a length generally corresponding to the common length L of the main body 600 and the legs 602, 604, 606 of the inductor E-core. In the illustrated embodiment, the two inductor core channels have a common height. As illustrated, the common height of the two inductor core channels may be approximately half the thickness T of the inductor core main body; however, the height may be varied.

Each of the third flange 860 and the fourth flange 870 includes a plurality of wiring slots 920 (e.g., four in each flange). Two of the wiring slots of each flange are positioned at the front of the bobbin 530, and two of the wiring slots are positioned at the rear of the bobbin. The fourth flange further includes a plurality of wiring guide posts 922 (e.g., four posts) that extend vertically upward from the uppermost surface 874 of the fourth flange. One of the posts is positioned at each of the four corners of the fourth flange. The third flange further includes a plurality of wiring notches 924 (e.g., four notches) positioned near the four corners of the third flange. The second flange 820 also includes a plurality of wiring notches 926 (e.g., four notches) positioned near the four corners of the second flange. In the illustrated embodiment, the wiring notches of the second flange are in substantial alignment with the wiring notches of the third flange.

The first flange 800 includes a plurality of wiring notches 930 (e.g., six notches). Three of the wiring notches are positioned along the front of the bobbin 530; and three of the wiring notches are positioned along the rear of the bobbin. The three front wiring notches extend vertically from the uppermost surface 804 of the first flange through the first pin rail 810. The three rear wiring notches extend vertically from the uppermost surface of the first flange through the second pin rail 812.

Figure 9:
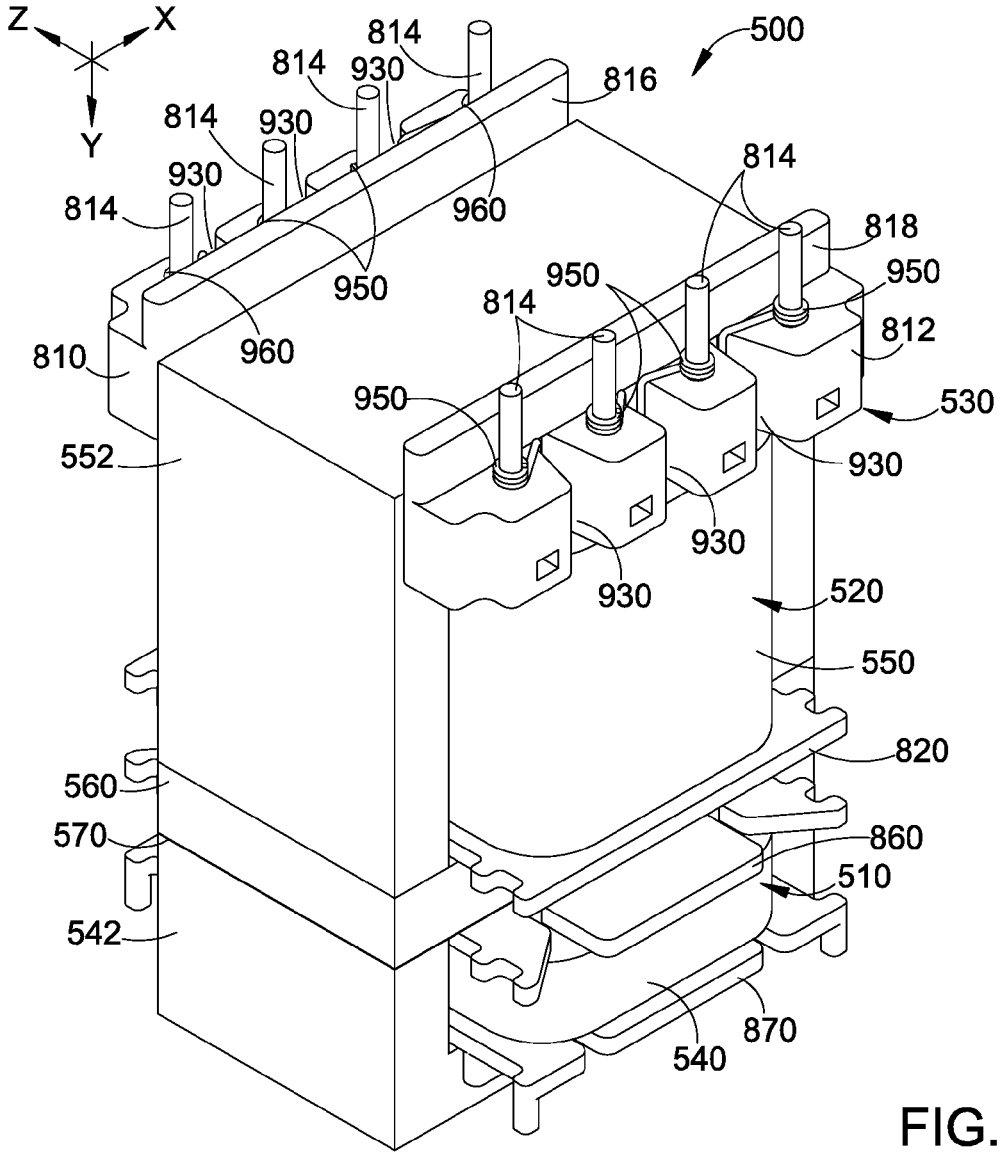
FIG. 9 illustrates the combined magnetic assembly of FIG. 8; the view flipped 180 degrees about the X-axis and then rotated 90 degrees about the Y-axis to show the surfaces hidden in FIG. 8.
Figure 10:
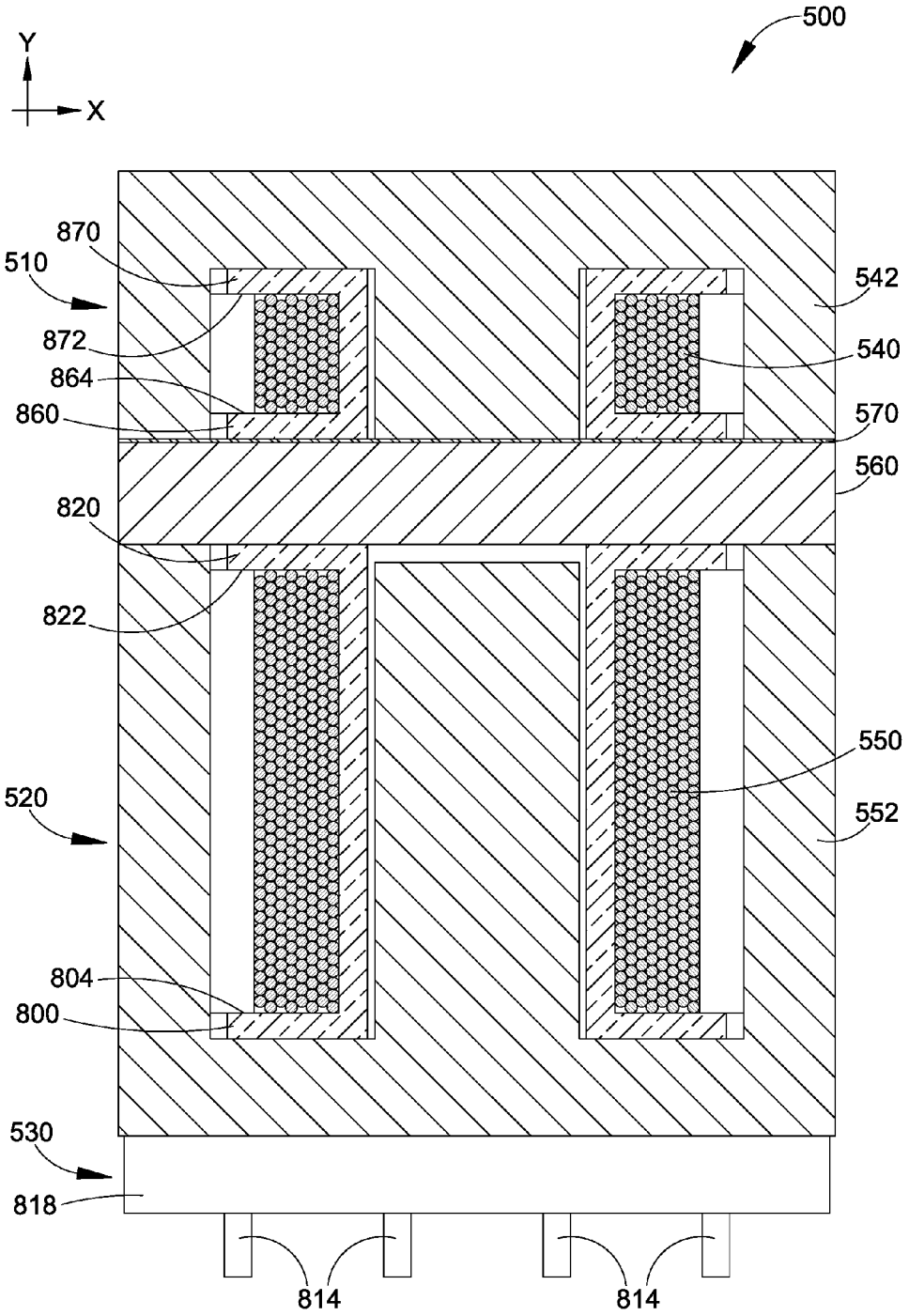
FIG. 10 illustrates a front cross-sectional view of the combined magnetic assembly of FIG. 8 taken along the line 10-10 in FIG. 8.

The transformer coil 550 is wound around the first winding portion 830 in a conventional manner. The coil includes the primary and secondary windings of the transformer 520. As shown in FIG. 9, terminal ends 950 of the windings of the transformer coil pass through selected notches 930 and are connected to selected pins 814 of the first (front) pin rail 810, the second (rear) pin rail 812, or both pin rails. In the illustrated example, four of the terminal ends are connected to pins in the second pin rail and two of the terminal ends are connected to pins in the first pin rail.

As further shown in FIGS. 9 and 11, the inductor coil 540 is wound around the second winding portion 880 in a conventional manner. In the illustrated embodiment, each of two terminal ends 960 of the winding in the inductor coil passes through a respective winding slot 920 of the fourth flanges 870; wraps around a respective winding post 922; passes through a respective wiring notch 924 of the third flange; passes through a respective wiring notch 926 of the second flange 820; passes through a respective wiring notch 930 of the first flange 800; and is connected to a respective pin 814 of the first pin rail 810. Other wire routing configurations and pin selections can also be used.

The combined magnetic assembly 500 is completed by inserting the transformer E-core 552, the inductor E-core 542, the I-core 560 and the gap spacer 570 into the bobbin 530. The I-core and the gap spacer are inserted into the I-core receiving passage 866 with the second (lower) planar surface 702 of the I-core facing downward toward the upper surface 824 of the second flange 820. The gap spacer is positioned between the first (upper) planar surface 700 of the I-core and the lowermost surface 862 of the third flange 860.

The center leg 656 of the transformer E-core 552 is inserted into the first passage 840 of the bobbin 530 from the bottom of the bobbin. The transformer E-core is fully inserted with the inner surface 662 of the main body 650 of the transformer E-core adjacent to the lowermost surface 822 of the first flange 800. The end surfaces 670, 680 of the outer legs 652, 654 of the transformer E-core extend so that the end surfaces are at least flush with the uppermost surface 624 of the second flange 620 and may extend slightly beyond the uppermost surface to assure solid contact with second (lower) planar surface 702 of the I-core 570. The main body 650 of the transformer E-core fits snugly between the inner surface of the channel wall 816 of the first pin rail 810 and the inner surface of the channel wall 818 of the second pin rail 812. As described above, the heights of the pin rails with respect to the lowermost surface 802 of the first flange are selected to be at least as great as thickness T of the main body of the E-core such that the main body of the E-core does not extend below the channel walls. Thus, the mail body of the E-core does not interfere with the insertion of the pins 814 into a printed circuit board (not shown).

The center leg 606 of the inductor E-core 542 is inserted into the second passage 890 of the bobbin 530 from the top of the bobbin. The inductor E-core is fully inserted with the inner surface 612 of the main body 600 of the inductor E-core adjacent to the uppermost surface 874 of the fourth flange 870. When fully inserted, the end surface 640 of the center leg and the end surfaces 620, 630 of the two outer legs 602, 604 of the inductor E-core are at least substantially flush with the lowermost surface 862 of the third flange 860. The end surfaces may extend slightly beyond the lowermost surface to assure that the end surfaces contact the gap spacer 570 and are thus spaced apart from the I-core by no more than the gap distance provided by the gap spacer. The main body of the inductor E-core fits snugly between the inner surfaces of the first inductor core channel 900 and the second inductor core channel 902.

The gap spacer 570 provides an equal gap between the first planar surface 700 of the I-core 560 and the end surfaces 620, 630, 640 of the three legs 602, 604, 606 of the inductor E-core 542. The equal gap reduces the flux interference between the transformer 520 and the inductor 510. The gap spacer also aids in forcing the second (lower) planar side 702 of the I-core against the end surfaces 670, 680 of the outer legs 652, 654 of the transformer E-core 552 so that no gap is formed between the outer legs of the transformer E-core and the I-core. As discussed above, the center leg 656 of the transformer E-core is shorter than the outer legs of the transformer E-core such that a single gap (G) is formed between the end surface 690 of the center leg of the transformer E-core and the second planar surface of the I-core.

Figure 24:
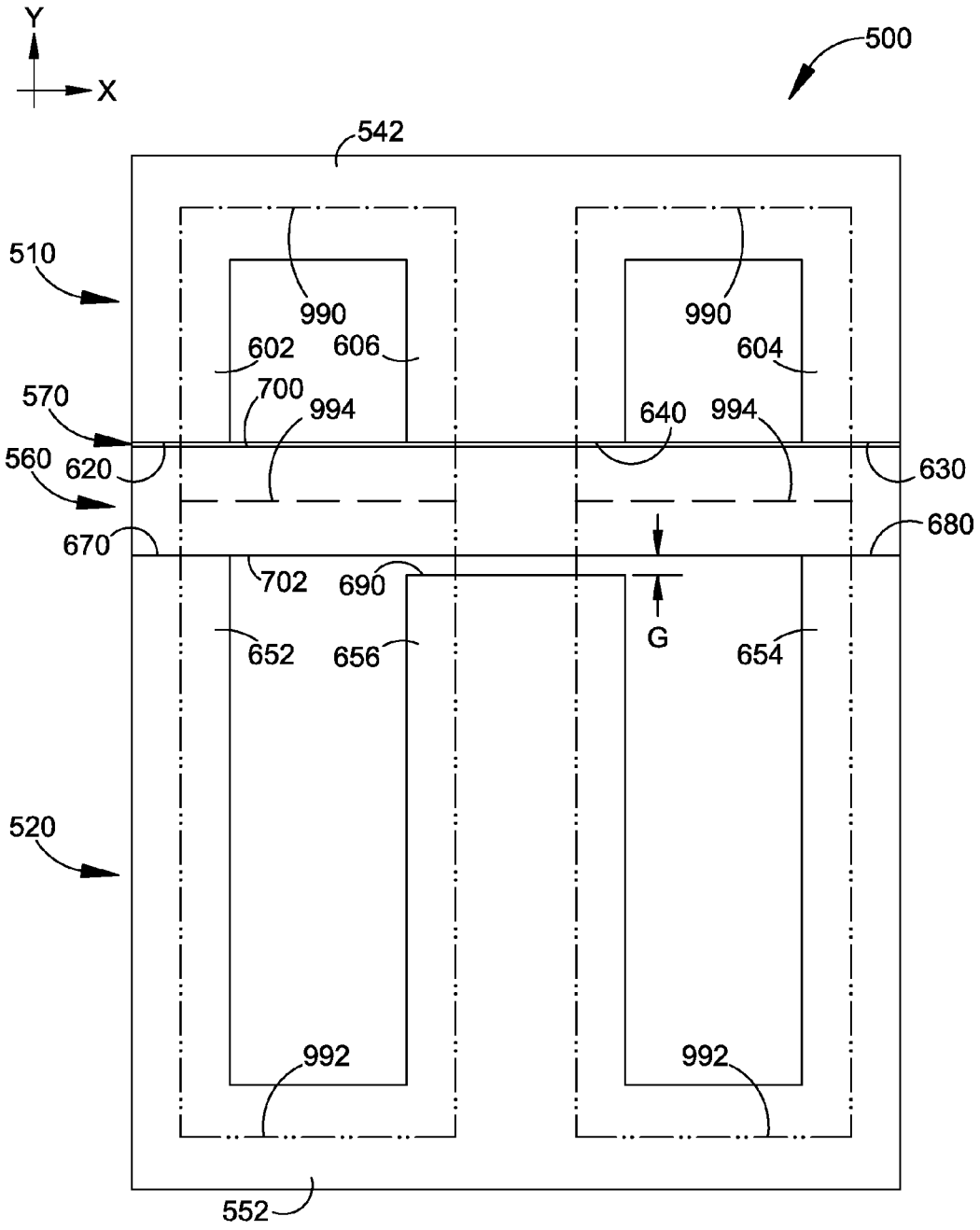
FIG. 24 illustrates a schematic representation of the front cross-sectional view of the combined magnetic assembly in accordance with FIG. 11, the view annotated to illustrate the flux pattern in the resonant inductor E-core in dash-dot lines, the flux pattern in the output transformer E-core in dash-dot-dot lines, and the shared flux pattern in the common I-core in dashed lines.

The effect of the foregoing construction is illustrated in FIG. 24, which is a schematic representation of the front elevational view of the combined magnetic assembly 500. The schematic representation shows a flux pattern 990 in the inductor E-core in dash-dot lines; shows a flux pattern 992 in the transformer E-core in dash-dot-dot lines; and shows a flux pattern 994 in the common I-core in dashed lines. As illustrated, the inductor and the transformer produce a shared flux pattern in the I-core.

As described above, the combined magnetic assembly 500 integrates the functions of the resonant inductor 510 and the output transformer 520 into a single assembly with a smaller printed circuit footprint than two separate devices. The resonant inductor and the output transformer are stacked to provide the reduced footprint. A single bobbin 530 is used for both the resonant inductor and the output transformer. The combined magnetic assembly shares the common I-core 560 positioned between the ends of the legs of the two E-cores 542, 552 within the I-core receiving passage 866 in the bobbin. The two E-cores and the common I-core form an "E-I-E" structure with the I-core providing a shared flux path for each of the E-cores. The combined magnetic assembly reduces the printed circuit board area needed for the two functions (resonant inductor and output transformer). By requiring only two E-cores and one shared I-core, the overall volume of core material is reduced. By using only a single bobbin for both functions, the overall costs of material are reduced.

The previous detailed description has been provided for the purposes of illustration and description. Thus, although there have been described particular embodiments of the present invention of a new and useful "Output Transformer and Resonant Inductor in a Combined Magnetic Structure," it is not intended that such references be construed as limitations upon the scope of this invention except as set forth in the following claims.

What is claimed is:

1. A magnetic assembly comprising:

a bobbin structure having a first flange, the first flange having a first outer flange surface, a second flange spaced apart from the first flange in a first direction, a third flange spaced apart from the second flange in the first direction, a fourth flange spaced apart from the third flange in the first direction, a first core passage extending between the first flange and the second flange, a second core passage extending between the third flange and the fourth flange, a third core passage, the third core passage positioned between the second flange and the third flange, the third core passage oriented perpendicular to the first core passage and the second core passage, a first pin rail and a second pin rail, the first pin rail and the second pin rail extending perpendicularly from the first flange in a second direction opposite the first direction, the first pin rail spaced apart from the second pin rail by a core channel on the outer surface of the first flange, the first core passage extending to the core channel;

a first coil at least partially surrounding the first core passage;

a second coil at least partially surrounding the second core passage;

an I-core having at least a central portion positioned in the third core passage, the I-core having a first planar surface and a second planar surface;

a first E-core having a main body positioned in the core channel between the first pin rail and the second pin rail, having a center leg positioned in the first core passage and having a first outer leg and a second outer leg, the first and second outer legs of the first E-core having respective end surfaces contacting the first planar surface of the I-core; and a second E-core having a center leg positioned in the second core passage and having a first outer leg and a second outer leg, the first and second outer legs and the center leg of the second E-core having respective end surfaces positioned proximate to and spaced apart from the second planar surface of the I-core.

2. The magnetic assembly of claim 1, wherein the center leg of the first E-core is shorter than the outer legs of the first E-core by a length difference such that an end surface of the center leg of the first E-core is spaced apart from the first planar surface of the I-core by a gap distance equal to the length difference.

3. The magnetic assembly of claim 1, further including a gap spacer positioned between the second planar surface of the I-core and the end surfaces of the first outer leg, the second outer leg and the center leg of the second E-core, the gap spacer having a thickness selected to provide a predetermined gap spacing between the end surfaces of the first outer leg, the second outer leg and the center leg of the second E-core and the second planar surface of the I-core.

4. The magnetic assembly of claim 1, wherein:

the first coil, the first E-core and at least a first portion of the I-core comprise a first inductive device; and the second coil, the second E-core and at least a second portion of the I-core comprise a second inductive device.

5. The magnetic assembly of claim 4, wherein:

the first inductive device is a transformer; and the second inductive device is an inductor.

6. A bobbin for a magnetic assembly, comprising:

a first flange, a second flange, a third flange and a fourth flange, the second flange spaced apart from the first flange in a first direction, the third flange spaced apart from the second flange in the first direction, the fourth flange spaced apart from the third flange in the first direction, the first flange having an outer surface facing in a second direction, the second direction opposite the first direction;

a first pin rail and a second pin rail, each pin rail extending perpendicularly from the first flange in the second direction, the first pin rail and the second pin rail spaced apart along the outer surface of the first flange by a core channel formed on the outer surface of the first flange;

a first winding portion positioned between the first flange and the second flange;

a second winding surface positioned between the third flange and the fourth flange;

an I-core receiving passage positioned between the second flange and the third flange, the I-core receiving passage oriented in a third direction, the third direction perpendicular to the second direction;

a first core leg receiving passage extending in the first direction from the core channel formed on the outer surface of the first flange to the second flange; and a second core leg receiving passage extending in the second direction from the fourth flange to the third flange.

7. A magnetic assembly, comprising:

a bobbin structure, the bobbin structure including:

a first flange;

a second flange parallel to the first flange and displaced away from the first flange in a first direction;

a first core passage extending from the first flange to the second flange, the first core passage perpendicular to the first flange and the second flange;

a first winding surface surrounding the first core passage between the first flange and the second flange;

a third flange parallel to the second flange and displaced away from the second flange in the first direction, the third flange coupled to the second flange by at least one spacer wall to define an I-core receiving slot between the second flange and the third flange;

a fourth flange parallel to the third flange and displaced away from the third flange in the first direction;

a second core passage extending from the third flange to the fourth flange, the second core passage perpendicular to the third flange and the fourth flange;

a second winding surface surrounding the second core passage between third flange and the fourth flange;

a first pin rail and a second pin rail, the first pin rail and the second pin rail extending perpendicularly from the first flange in a second direction opposite the first direction, the first pin rail spaced apart from the second pin rail by a core channel, the first core passage extending to the core channel;

at least a first coil wound around the first winding surface;

at least a second coil wound around the second winding surface;

a first E-core having a core body, and having a respective first outer leg, a respective second outer leg and a respective center leg, each leg having a respective end surface, the core body of the first E-core inserted into the core channel and the center leg of the first E-core inserted into the first core passage with the end surface of the center leg positioned proximate to the second flange;

a second E-core having a respective first outer leg, a respective second outer leg and a respective center leg, each leg having a respective end surface, the center leg of the second E-core inserted into the second core passage with the end surface of the center leg positioned proximate to the third flange; and an I-core positioned in the I-core receiving slot, the I-core having a first planar side positioned against the end surfaces of the first outer leg and the second outer leg of the first E-core, the I-core having a second planar side positioned proximate to and spaced apart from the end surfaces of the first outer leg, the second outer leg and the center leg of the second E-core.

8. The magnetic assembly of claim 7, wherein the center leg of the first E-core is shorter than the outer legs of the first E-core by a length difference such that an end surface of the center leg of the first E-core is spaced apart from the first planar surface of the I-core by a gap distance equal to the length difference.

9. The magnetic assembly of claim 7, wherein:

the first coil, the first E-core and at least a first portion of the I-core comprise a first inductive device; and the second coil, the second E-core and at least a second portion of the I-core comprise a second inductive device.

10. The magnetic assembly of claim 9, wherein:

the first inductive device is a transformer; and the second inductive device is an inductor.

11. The magnetic assembly of claim 7, further including a gap spacer positioned between the second planar side of the I-core and the end surfaces of the first outer leg, the second outer leg and the center leg of the second E-core, the gap spacer having a thickness selected to provide a predetermined gap spacing between the end surfaces of the first outer leg, the second outer leg and the center leg of the second E-core and the second planar side of the I-core.

12. The magnetic assembly of claim 11, wherein the gap spacer comprises a polyester film material having a thickness selected to provide the predetermined gap.

13. The magnetic assembly of claim 12, wherein the thickness of the gap spacer is in a range between 0.0025 inch and 0.0200 inch.

14. The magnetic assembly of claim 11, wherein the gap spacer comprises a polyethylene terephthalate (PET) film.

* * * * *